United States Patent [19]

Colbert

[11] 4,253,624

[45] Mar. 3, 1981

[54] WELDING WIRE DISPENSER

[76] Inventor: Robert E. Colbert, 3843 E. Walmont, Jackson, Mich. 49203

[21] Appl. No.: 137,839

[22] Filed: Apr. 7, 1980

Related U.S. Application Data

[63] Continuation of Ser. No. 2,231, Jan. 10, 1979, abandoned.

[51] Int. Cl.[3] ..... B65H 49/00

[52] U.S. Cl. ..... 242/128

[58] Field of Search ..... 242/128, 129.6, 129.72, 242/129.8, 54 R

[56] References Cited

U.S. PATENT DOCUMENTS

| | | | |
|---|---|---|---|
| 1,159,815 | 11/1915 | Walsh | 242/128 |
| 1,834,159 | 12/1931 | King, Jr. et al. | 242/128 |
| 1,846,524 | 2/1932 | Lindsay | 242/128 |
| 2,286,460 | 6/1942 | Brown | 242/128 |
| 2,319,828 | 5/1943 | Rohweder | 242/128 |
| 2,880,305 | 3/1959 | Baird | 219/130 |
| 3,311,320 | 3/1967 | Taylor | 242/128 |
| 3,618,873 | 11/1971 | Fons et al. | 242/128 |
| 3,648,947 | 3/1972 | Shelton | 242/128 |

FOREIGN PATENT DOCUMENTS

| | | | |
|---|---|---|---|
| 836528 | 6/1960 | United Kingdom | 242/128 |

*Primary Examiner*—Leonard D. Christian
*Attorney, Agent, or Firm*—Beaman & Beaman

[57] ABSTRACT

A dispenser for coiled wire, particularly welding wire, which is supported upon a conventional wood pallet, the dispenser including a vertically disposed column having an upper end including a cover extending over the coil and nut means for tightly forcing the cover against the coil. A wire guide is rotatably mounted upon the column upper end rotating about the coil and dispensing wire therefrom, and the column lower end includes a hook bracket extending under pallet structure whereby tightening of the nut means pulls the bracket into a tight relationship with the pallet fixing the dispenser with respect to the coil and pallet, and simultaneously firmly maintaining the wire coil upon the pallet.

10 Claims, 3 Drawing Figures

WELDING WIRE DISPENSER

This is a continuation of application Ser. No. 002,231 filed Jan. 10, 1979 and now abandoned.

BRIEF DESCRIPTION OF THE INVENTION

The invention pertains to dispensers for coiled wire, and particularly relates to dispensing coiled wire supported upon a pallet.

Wire is normally stored and transported while in coils, and the coils may be wound on reels or spools, boxed, banded, placed over spindles, or otherwise handled. Coils of welding wire used to supply electric welding equipment are often dispensed from coils as shown in U.S. Pat. No. 2,880,305. Welding wire can be most economically purchased in large coils, but previously, welding apparatus dispensers were not capable of handling large welding wire coils, and consequently, wire costs are greater than they would be if coils weighing several hundred pounds could be utilized. To handle such heavy coils it is necessary that the same be placed upon material handling devices, such as a pallet, which may be readily lifted, transported and positioned by a lift truck or similar material handling apparatus.

It is known to dispense wire from a coil by means of a guide rotatable about the coil axis, the wire being fed through the guide and into a stationary eye or conduit. Typical wire dispensers of this type are shown in U.S. Pat. Nos. 1,159,815; 1,834,159; 1,846,524; 2,286,460 and 2,319,828. Such devices, as shown in several of the aforementioned patents, include cover members which engage the upper portion of the spool and brake means control over run of the wire guide. The dispenser shown in U.S. Pat. No. 2,880,305 is particularly intended for dispensing welding wire, but this dispenser is used with relatively small wire coils.

In the past, a coiled wire dispenser for welding wire has not been available which could utilize large, economical wire coils. Usually, it is necessary to transfer the wire coil to specially built coil dispensing apparatus, and this necessity to handle the coil has limited the coil size as well as other handling and dispensing factors.

It is an object of the invention to provide a wire coil dispenser which may be employed with pallet supported wire coils directly, without necessitating the need to transfer the coiled wire from the pallet on which it is shipped.

A further object of the invention is to provide a coiled wire dispenser which may be directly installed upon a conventional pallet, and wherein installation of the dispenser tends to hold the wire coils on the pallet during use and augments the relationship between the pallet and its coiled wire load.

In the practice of the invention the dispenser includes a vertically oriented column having wire guide means rotatably associated with the column upper end through which the wire is removed from the coil exterior and fed in the desired direction. The column upper end also includes a cover engaging the coil upper surface and threads defined upon the column receive nut means for forcing the cover into firm engagement with the coil upper surface.

The lower end of the column includes a hook type bracket having a horizontal portion which is received between the lowermost horizontal slats of a conventional wood pallet. The horizontal hook portion is of a vertical dimension no greater than the vertical dimension of the lower pallet slats and the hook may be readily placed between the pallet slats and positioned as desired substantially coaxial with the wire coil.

Tightening of the nut means simultaneously forces the cover into engagement with the coil upper surface and draws the hook upwardly to produce a firm mechanical interconnection between the column and pallet. Thus, rotation of the nut means firmly positions the column relative to the wire coil and pallet, and the forces imposed upon the coil by the cover tend to maintain the shape and configuration of the wire coil as it is depleted, and prevents the wire coil from shifting relative to the pallet.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
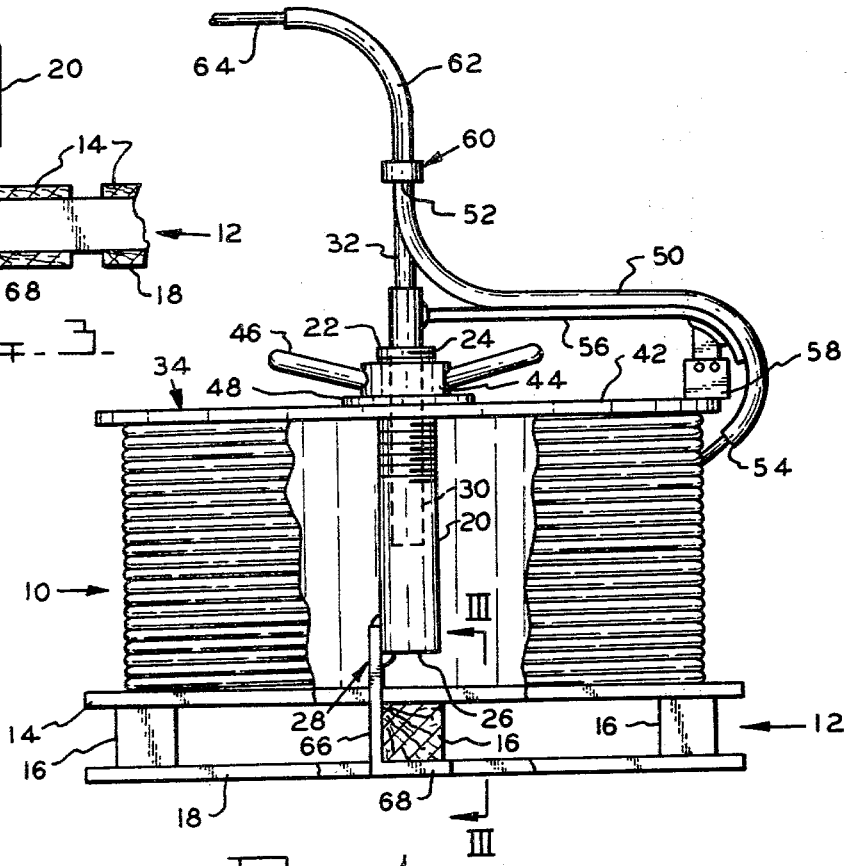
FIG. 1 is an elevational view, partially in section, illustrating a wire dispenser in accord with the invention as mounted upon a pallet.
Figure 2:
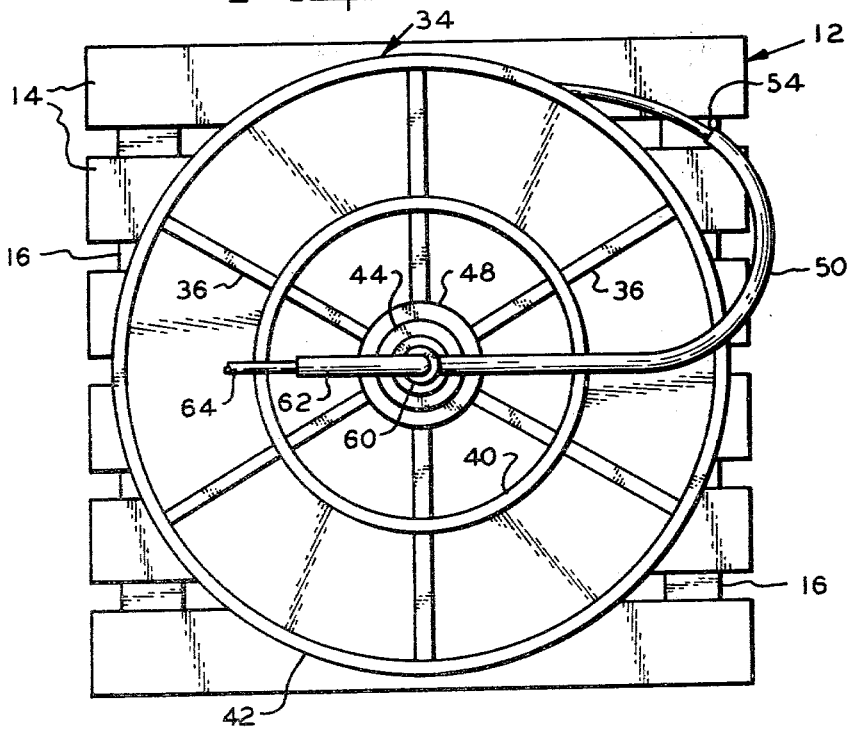
FIG. 2 is a top plan view of FIG. 1.

With reference to FIG. 1, a wire coil, such as of welding wire, generally indicated at 10 is mounted upon a conventional wood pallet 12. The coil 10 may weigh several hundred pounds, and is normally strapped or banded to the pallet for shipping purposes. The pallet includes a plurality of spaced parallel upper slats 14 nailed, screwed or otherwise affixed to three primary wood base members or elements 16 perpendicularly disposed to the slats 14. Such material handling pallets also usually include lower parallel slats 18 transversely disposed to base elements 16 and directly located below slats 14.

The dispenser includes a vertically extending column 20 of cylindrical configuration having an upper end 22 which is provided with exterior threads 24. The column lower end 26 includes a hook bracket 28 welded thereto, which will be later described in detail.

The column 20 includes a blind hole 30 coaxially bored therein rotatably receiving the guide support shaft 32.

A circular cover 34 rests upon the upper coils of coil 10 and the cover consists of a plurality of radially extending elements 36 affixed to a hub 38 and reinforced by a circular ring 40 and welded at their outer ends to circular rim 42 which extends slightly beyond the periphery of the wire coil. A nut 44 threaded upon threads 24 may be rotated by handles 46, and the washer 48 engaging the nut also engages the cover hub 38 wherein tightening of the nut 44 produces a downward force upon the cover 34.

The guide support shaft 32 supports a shaped conduit wire guide 50 which has an outlet at 52 coaxial with the shaft 32, and a wire inlet at 54 disposed adjacent the wire coil periphery. Bracing rod 56 extends toward the outer portion of the guide conduit 50 from the shaft 32, and a braking member 58 formed of friction material such as rubber, leather, or the like rotates with the guide and engages cover rim 42 to function as a brake to prevent overtravel of the guide as it is rotated during wire dispensing.

Hollow bearing structure generally indicated at 60 is located at the upper end of the guide conduit 50 at outlet 52 and supports the wire discharge conduit 62. Discharge conduit 62 is relatively stationary and dispenses the wire entering inlet 54 in the desired direction, such as toward the welding machine. The bearing structure 60 may take any conventional form, and it will be appreciated that as the wire 64 is pulled from the discharge conduit 62 the guide 50 will rotate about the axis of the column 20 and guide the wire being removed from the coil into the inlet 54.

Figure 3:
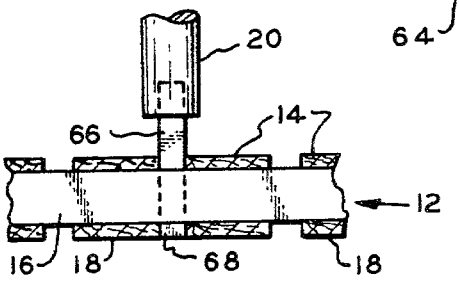
FIG. 3 is an enlarged, detail, elevational sectional view of the column hook as taken along Section III—III of FIG. 1.

The wire dispensing apparatus is mounted relative to the coil 10 and pallet 12 by the hook bracket 28 which is welded to the column lower end 26. The hook includes a vertically extending portion 66, and a substantially horizontally disposed portion 68 which extends below the central pallet base element 16. As will be appreciated from FIGS. 1 and 3, the vertical dimension of the hook portion 68 is no greater than the vertical dimension of the lower pallet slats 18 whereby the hook may be readily inserted under the central base element 16 even though the lower slats 18 are resting upon a solid floor. The hook 28 is of a width capable of being inserted between both the upper and lower slats 14 and 18, FIG. 3, and it will be appreciated that tightening of the nut 44 to force the cover 34 into engagement with the coil 10 also imposes an upward force on the hook to firmly engage the portion 68 with the associated base element 16. Thus, tightening of the nut 44 provides an effective mechanical interconnection between the wire dispensing column, cover, the wire coil and pallet.

The wire dispenser construction, and particularly the use of the hook bracket 28, permits the dispenser to be installed merely by lowering the column through the center of a strapped wire coil. The hook portion 68 may be inserted under the central base element 16 and the nut 44 tightened to firmly force the cover 34 against the coil. Thereupon, the banding straps binding the coil may be cut, if they have not already been severed, and the dispenser may be firmly installed prior to the coil being released from its transport banding.

The forces imposed upon the coiled wire by the cover 34 tend to maintain the coil configuration during use, and as many wire coils include an inner cylindrical spool or other similar member which defines the coil length the use of the cover aids in maintaining the coil configuration even until the coil is substantially depleted. Installation of the dispenser of the invention is readily accomplished by unskilled personnel, and the dispenser structure may be fabricated at relatively low cost.

It will be appreciated that various modifications to the inventive concept may be apparent to those skilled in the art without departing from the spirit and scope of the invention.

I claim:

1. A dispenser for coiled welding wire supported upon a pallet having a plurality of spaced support slats affixed to a transversely disposed base element, comprising in combination, a column having a lower end and an upper end, a cover member mounted upon the column upper end adapted to engage and overlie the upper end of a coil of wire supported on the pallet, first connection means defined on said column upper end, second connection means cooperating with said first connection means axially displacing said cover on said column toward the pallet producing a vertical upward force on said column, rotatable wire guide means mounted on said column upper end for dispensing wire from the coil, and pallet attachment means defined upon said column lower end adapted to extend under pallet structure whereby operation of said first and second connection means fixes said column relative to the pallet and wire coil.

2. In a dispenser for coiled wire as in claim 1 wherein said pallet attachment means includes a hook adapted to extend under the pallet base element.

3. In a dispenser for coiled wire as in claim 2 wherein said hook includes a vertical portion disposed adjacent the pallet base element and a horizontal portion extending under the base element.

4. In a dispenser for coiled wire as in claim 3, said pallet having a plurality of lower spaced slats affixed to the underside of the base element, the vertical dimension of said hook horizontal portion being no greater than the vertical dimension of said lower spaced slats and said hook horizontal portion received between adjacent lower slats.

5. In a dispenser for coiled wire as in claim 1 wherein said first connection means comprises threads defined on said column upper end, and said second connection means comprises a threaded nut mounted upon said threads.

6. A dispenser for coiled welding wire supported upon a pallet having a plurality of spaced support slats affixed to a transversely disposed base element, the dispenser including a column having a lower end and an upper end, a cover member mounted upon the column adapted to engage and overlie the upper end of a coil wire, attachment means defined on said column upper end mounting said cover member thereon, and rotatable wire guide means mounted on the column upper end for dispensing wire from the coil, the improvement comprising pallet attachment means defined upon the column lower end adapted to attach directly to the pallet, said pallet attachment means comprising a bracket of a hook configuration having a substantially horizontal portion adapted to extend under the pallet base element, the pallet including a plurality of lower spaced slats affixed to the underside of the base element directly below the spaced support slats, the vertical dimension of said bracket horizontal portion being no greater than the vertical dimension of said lower spaced slats, said bracket including a vertical portion received between adjacent support slats.

7. Apparatus for dispensing a filamentary material from a stationary coil having a periphery and an axis, wherein the dispenser includes a guide support coaxially supported relative to the coil axis for rotation about the coil axis, the improvement comprising, a rotatable filament guide mounted upon the guide support for rotation therewith about the coil axis removing the filament from the coil, said guide including a hollow tubular member having a filament entrance end and a bearing supporting end concentric to the coil axis, a hollow bearing directly mounted upon said guide bearing supporting end concentric to the coil axis, and a relatively stationary tubular filament guide supported upon said bearing receiving filament from said rotatable guide and dispensing filament in a predetermined direction.

8. In an apparatus for dispensing a filamentary material as in claim 7, said rotatable guide comprising an elongated contoured tube, said guide filament entrance end being disposed adjacent the coil periphery.

9. Apparatus for dispensing a filamentary material from a stationary coil having an upper end, a lower end, a periphery and an axis wherein the coil lower end is supported upon a pallet, comprising, in combination, a column having an upper end and a lower end, coil engaging column support means mounted upon said column upper end, pallet engaging means defined upon said column lower end, a guide support rotatably mounted upon said column upper end, a tubular first guide mounted upon said guide support for rotation therewith having a filament entrance end and a bearing supporting end concentric to the coil axis, a hollow bearing mounted upon said guide bearing supporting end concentric to the coil axis, and a relatively stationary tubular filament guide supported upon said bearing receiving filament from said first guide and dispensing filament in a predetermined direction.

10. Apparatus for dispensing a filamentary material as in claim 9, said coil engaging column support means comprising a cover adapted to engage the coil upper end and force producing means for producing an upward axial force upon said column, said pallet engaging means including a hook member adapted to extend under a portion of the pallet.

* * * * *